US009573752B2

(12) United States Patent
Bond et al.

(10) Patent No.: US 9,573,752 B2
(45) Date of Patent: Feb. 21, 2017

(54) LIQUID CONTAINER APPARATUS

(71) Applicant: Drink Saporé Inc., Calabasas, CA (US)

(72) Inventors: Stephen D. Bond, Agoura, CA (US); Ian Goldey, Agoura, CA (US)

(73) Assignee: DRINK SAPORÉ INC., Calabasas, CA (US)

( * ) Notice: Subject to any disclaimer, the term of this patent is extended or adjusted under 35 U.S.C. 154(b) by 0 days.

(21) Appl. No.: 14/754,450

(22) Filed: Jun. 29, 2015

(65) Prior Publication Data

US 2016/0185515 A1 Jun. 30, 2016

Related U.S. Application Data

(60) Provisional application No. 62/096,653, filed on Dec. 24, 2014, provisional application No. 62/096,661, filed on Dec. 24, 2014.

(51) Int. Cl.

| | |
|---|---|
| ***B67D 3/00*** | (2006.01) |
| ***B65D 85/72*** | (2006.01) |
| ***B65D 39/00*** | (2006.01) |
| ***B65D 51/16*** | (2006.01) |

(52) U.S. Cl.

CPC ..... *B65D 85/72* (2013.01); *B65D 39/0005* (2013.01); *B65D 51/1644* (2013.01); *B67D 3/00* (2013.01)

(58) Field of Classification Search

CPC . B65D 85/72; B65D 39/0005; B65D 51/1644; B67D 3/00

USPC ..... 222/482, 483, 484, 487, 511, 512

See application file for complete search history.

(56) References Cited

U.S. PATENT DOCUMENTS

| | | | | |
|---|---|---|---|---|
| 2,689,669 | A | 9/1954 | Ericson | |
| 3,926,339 | A | 12/1975 | Openchowski | |
| 4,162,747 | A | 7/1979 | Graf | |
| 4,834,270 | A * | 5/1989 | Messner | F16N 3/04 222/484 |
| 5,071,020 | A * | 12/1991 | Reutter | B65D 51/1644 220/203.06 |
| 5,273,083 | A | 12/1993 | Burrows | |
| 5,346,476 | A | 9/1994 | Elson | |
| 5,431,205 | A * | 7/1995 | Gebhard | B67D 3/0032 141/286 |

(Continued)

FOREIGN PATENT DOCUMENTS

| | | |
|---|---|---|
| EP | 1222135 | 8/2004 |
| WO | WO-9008707 | 8/1990 |

OTHER PUBLICATIONS

PCT International Search Report and Written Opinion (dated Apr. 1, 2016), International Application No. PCT/US2015/065839, International Filing Date: Dec. 15, 2015, 18.

*Primary Examiner* — Patrick M Buechner
*Assistant Examiner* — Jeremy W Carroll
(74) *Attorney, Agent, or Firm* — Blakely Sokoloff Taylor & Zafman LLP

(57) ABSTRACT

A vessel body has an interior cavity in which a liquid is to be contained, an upper hole that communicates with the interior cavity, and a lower hole that communicates with the interior cavity. A spring inside the vessel body is in a pre-loaded condition and that also plugs the upper hole and the lower hole. When the liquid is to be dispensed, the spring is further loaded to thereby simultaneously vent through the upper hole and pour through the lower hole. Other embodiments are also described and claimed.

31 Claims, 8 Drawing Sheets

(56) References Cited

U.S. PATENT DOCUMENTS

| | | | | |
|---|---|---|---|---|
| 2005/0139620 | A1* | 6/2005 | Heukamp | B65D 51/1644 222/494 |
| 2007/0007233 | A1* | 1/2007 | Brown | B65D 51/1644 215/342 |
| 2007/0290010 | A1* | 12/2007 | Nini | B67D 3/044 222/511 |

* cited by examiner

LIQUID CONTAINER APPARATUS

This is a non-provisional application which claims the benefit of the earlier filing date of U.S. Provisional Patent Application No. 62/096,653, filed Dec. 24, 2014, and also claims the benefit of the earlier filing date of a second U.S. Provisional Patent Application No. 62/096,661, filed Dec. 24, 2014.

FIELD

An embodiment of the invention relates to a gravity-fed liquid container apparatus that enables storage and dispensing of liquids, e.g. a beverage. Other embodiments are also described and claimed.

BACKGROUND

Existing liquid containers that rely on gravity to create a liquid flow (gravity fed dispensers) generally have a vent hole that prevents the creation of a vacuum as the liquid pours itself out of the container (without assistance from a pump). This is needed because a vacuum or a partial vacuum will inhibit the outward flow of the liquid. A vent hole also needs a valve or a cap in order to stop leakage through it, when the container is not in use.

Some liquid containers are made of a flexible material, which can be squeezed to create pressure and thereby improve the flow of the liquid. That method, however, produces erratic flow characteristics depending upon how hard a person squeezes the container. In addition, a flexible container typically works more efficiently when it is full of liquid, but as the bottle empties liquid flow becomes more difficult and erratic. As the container empties, a larger vacuum is created thereby creating more suction upon the remaining liquid in the container (and also because there is no vent hole and as such no help from the available atmospheric pressure).

SUMMARY

An embodiment of the invention is a container apparatus for liquids that vents and pours simultaneously from a vessel, in response to application of force from outside of the vessel in which the liquid is contained. The force is applied to a spring structure that is inside the vessel and that simultaneously biases both an inlet valve and an outlet valve into their closed positions. The application of force (upon the spring structure) opens the inlet valve for air to flow into the vessel (venting to the atmosphere), and simultaneously opens the outlet valve for the liquid to flow out of the vessel under force of gravity alone. Since the vessel pours and vents simultaneously (while the force keeps the spring structure loaded), there is essentially no vacuum or suction that is created which will impede the outflow of the liquid.

In one embodiment, the container apparatus has a vessel body having an interior cavity in which the liquid is contained, with an upper hole and a lower hole formed in the vessel body that communicate with the interior cavity. An upper plug fits the upper hole, a lower plug fits the lower hole, and a spring structure inside the vessel body is pre-loaded in order to simultaneously force or position the upper plug so as to obstruct the upper hole, and force or position the lower plug to obstruct the lower hole. This pre-loading of the spring structure causes the plugs to essentially close off their respective holes so as to prevent spillage or leakage of the liquid (that is inside the vessel body) through them, for example, when the container apparatus is shaken. When a force is applied to the upper plug while the lower plug rests against a stop structure (outside of the vessel body), this results in the spring structure being further loaded such that the upper and lower plugs are effectively released from their positions in which they were obstructing the holes, thereby allowing simultaneous venting through the upper hole and pouring (of the liquid) through the lower hole. In one embodiment, this liquid flow out of the vessel body needs only gravity, without requiring any pump. In addition, there is no need for another hole in the vessel body (that would have to be manually closed, for example, with a screw cap or other seal). The upper and lower plugs fit their respective holes and obstruct the holes by virtue of the spring structure being pre-loaded, so that the liquid will not spill or leak from the vessel body.

In one embodiment, the vessel body may pour from either its upper hole or its lower hole, by simply orienting the vessel body such that the hole from which the liquid flows out of the vessel body is positioned below the other hole, which serves as a vent.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, for purposes of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever aspects of the embodiments described here are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
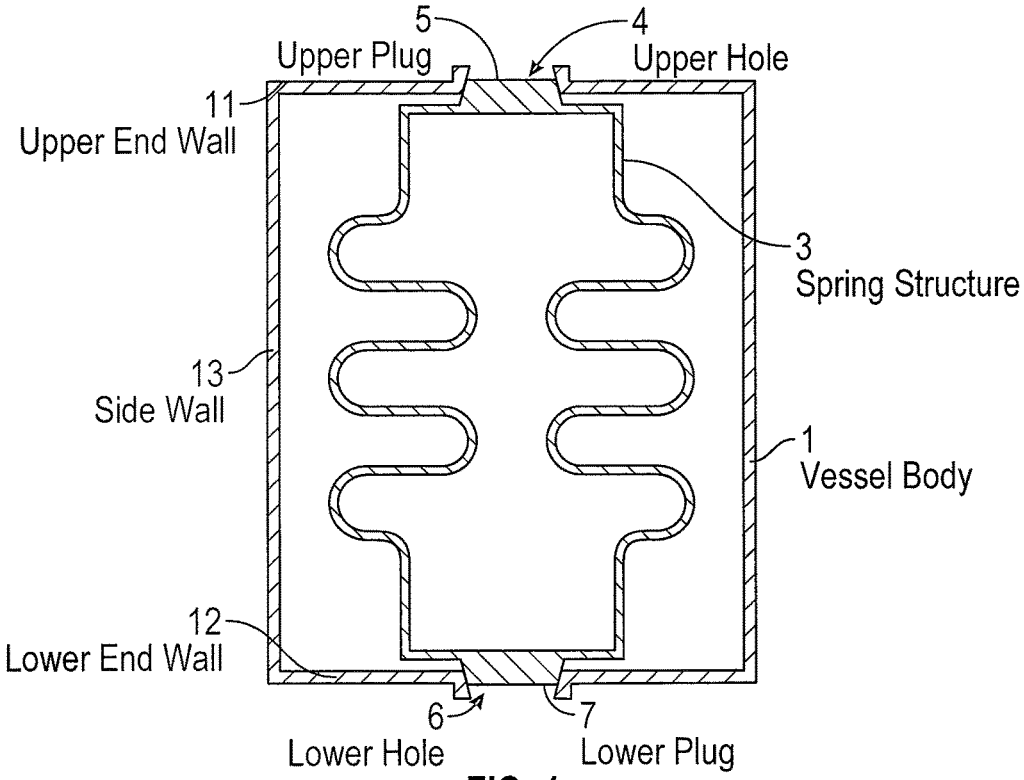
FIG. 1 is a cross-section view of a container apparatus for liquids, in accordance with one embodiment of the invention.

FIG. 1 is a cross-section view of a container apparatus for liquids, in accordance with one embodiment of the invention. The container apparatus has a vessel body 1 having an interior cavity that is to be filled with a liquid. See FIG. 6 for an example application of the container apparatus, for dispensing a beverage. It is expected that the container apparatus will work to dispense liquids of various viscosities, including ones that are as thick as catsup, for example. The vessel body 1 forms a three-dimensional solid structure that may be generally defined by a sidewall 13 that joins an upper end wall 11 and a lower end wall 12 as shown, to close off the vessel body 1. An upper hole 4 is formed in the upper end wall 11, and a lower hole 6 is formed in the lower end wall 12, through which air and/or liquid can flow between the interior cavity and outside of the vessel body 1. An upper plug 5 and a lower plug 7 fit the holes 4, 6, respectively. A spring structure 3 that is inside the vessel body 1 is pre-loaded as shown, so that it simultaneously a) forces or positions the upper plug 5 to obstruct the upper hole 4, and b) forces or positions the lower plug 7 to obstruct the lower hole 6 as shown. When the vessel body 1 is closed off in this manner, spillage or leakage of the liquid contained therein (through the upper hole 4 and/or the lower hole 6), is prevented, such as when the vessel body 1 is shaken). As explained below, liquid within the interior cavity flows out (downward) through the lower hole under force of gravity, when the spring structure 3 is further loaded. Note here that the inner face of the lower end wall 12 may be curved (rather than flat as shown in the figures) towards the longitudinal center axis (see FIG. 7) in order to ensure that all of the liquid can flow out of the vessel body 1 (through the lower hole 6).

Figure 2:
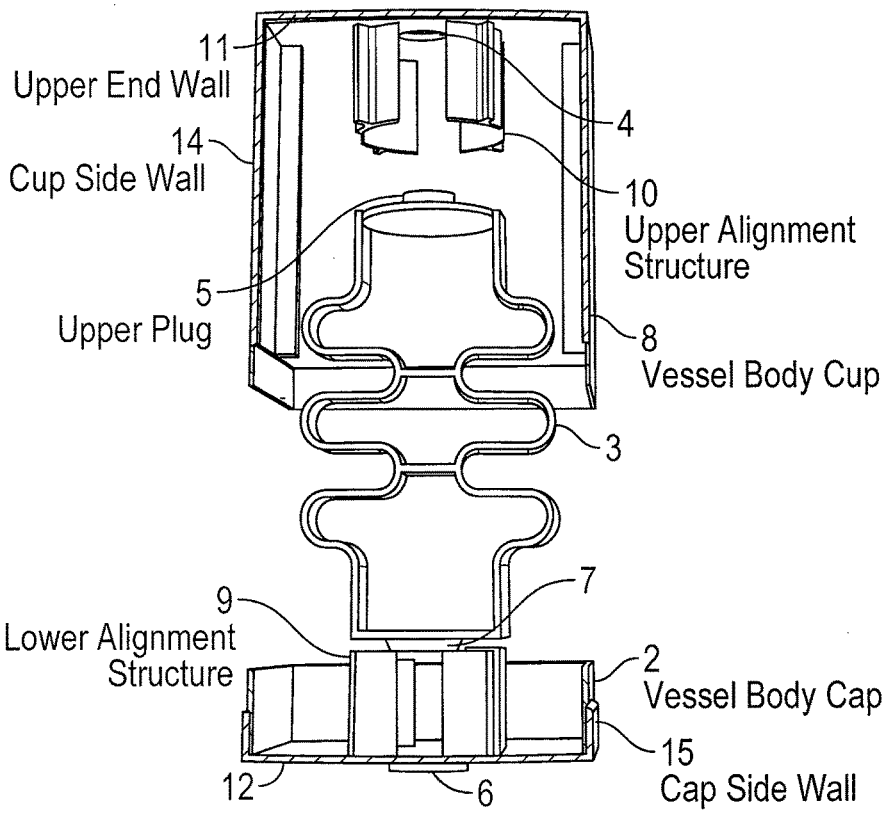
FIG. 2 is a cut-away view of an embodiment of the container apparatus showing how the vessel body may be assembled as two pieces.

In one embodiment, the spring structure 3 has one or more compression type spring elements (e.g., multiple spring elements that are joined end to end (not shown), or side by side as depicted in FIG. 1 and in FIG. 2), which are pre-loaded (e.g., compressed) while their upper end abuts an extended portion of the upper plug 5, and their lower end abuts an extended portion of the lower plug 7, again as shown in FIG. 1 and FIG. 2. The spring constant should be selected to be high enough so as to result in sufficient spring force being generated (once the spring structure 3 has been pre-loaded) to push the upper and lower plugs so that the latter remain in their positions in which they obstruct their respective upper and lower holes (so as to avoid leaks when the vessel body 1 is filled with liquid and is being shaken). The spring structure 3 may be a single piece that is made of injection molded plastic and is permanently joined to the upper plug 5 and the lower plug 7. Other realizations for the spring structure 3 are possible—see for example the embodiments of FIGS. 8-10 described further below.

Figure 3:
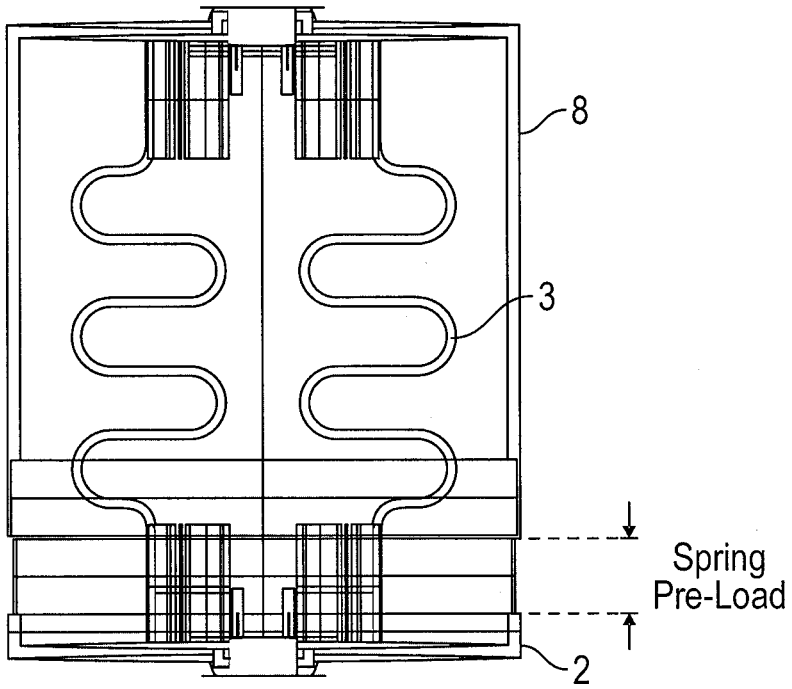
FIG. 3 illustrates an amount of spring pre-load that is applied in the embodiment of FIG. 2.
Figure 7:
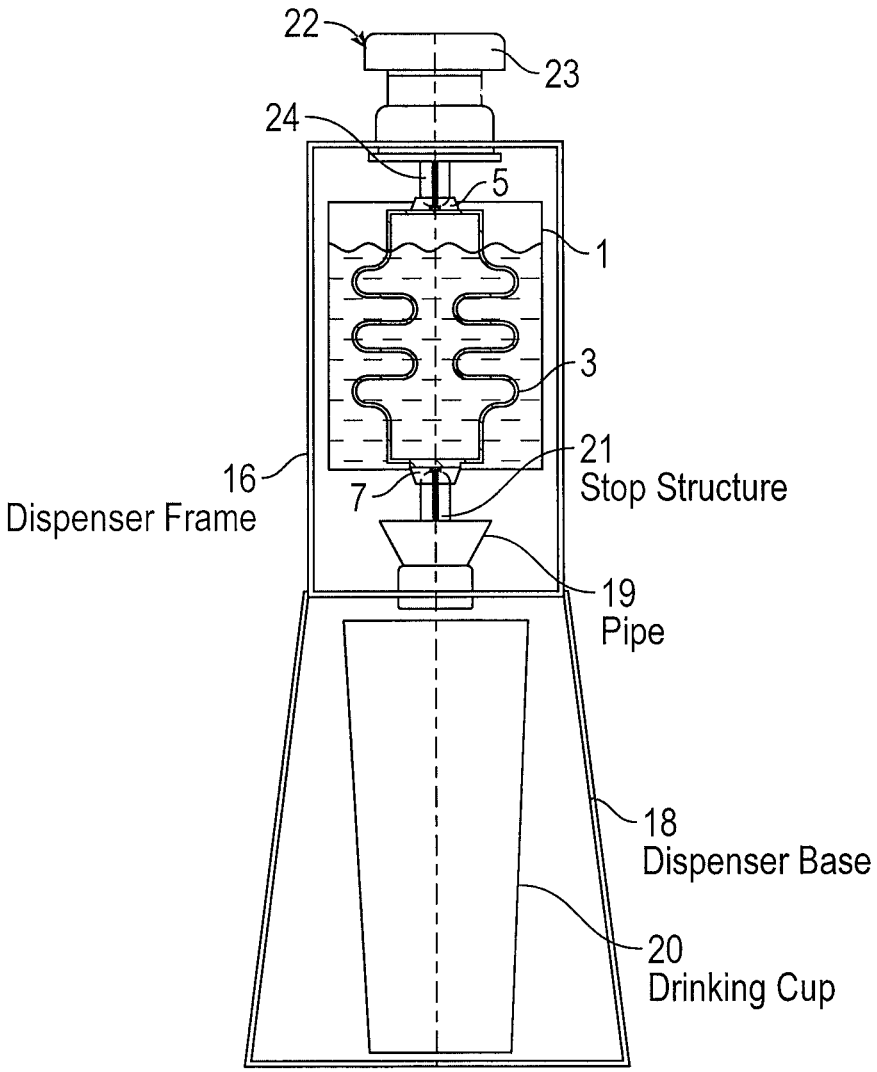
FIG. 7 shows the container apparatus having a vessel and a dispenser base used for filling a drinking cup.

The spring pre-load is made possible here because a combined length of the unloaded spring structure 3 and the upper and lower plugs 5, 7, as measured, for example, along a straight line through a center longitudinal axis that is depicted in FIG. 7, is greater than the internal length of the vessel body 1, that is the height of the vessel body 1 as measured between an inner face of the lower end wall 12 and an inner face of the upper end wall 11 (along the center longitudinal axis). This is depicted in the view of FIG. 3 as a spring pre-load distance, where such distance is the difference between the height of the interior cavity of the vessel body 1 and the combined length of the spring structure 3 and the abutting upper and lower plugs 5, 7. As seen in FIG. 2, the spring structure 3 is pre-loaded when it is placed in position so that its upper end abuts the upper plug 5, which fits the upper hole 4, while its lower end abuts the lower plug 7, which fits the lower hole 6.

FIG. 2 also shows an upper alignment structure 10, which extends downward from the inner face of the upper end wall 11 as shown, and serves to limit sideways movement of the upper end of the spring structure 3. Similarly, a lower alignment structure 9 extends upward from the inner face of the lower end wall 12, to limit sideways movement of the lower end of the spring structure 3. This manner of locating the spring structure (in a sideways or horizontal direction) may help better align the upper and lower plugs 5, 7 with their respective holes 4, 6 to ensure good seals. Note that while the alignment structures 9, 10 limit the sideways movement of the end portions of the spring structure 3 (that are abutting the extended portion of the plugs 5, 7), they do allow the end portions of the spring structure 3 to freely slide up or down (or in a vertical direction) relative to the vessel body 1, while the spring structure 3 is further loaded (to open the inlet and outlet valves so that the liquid can flow out) and then released (to close the inlet and outlet valves).

Figure 4A:
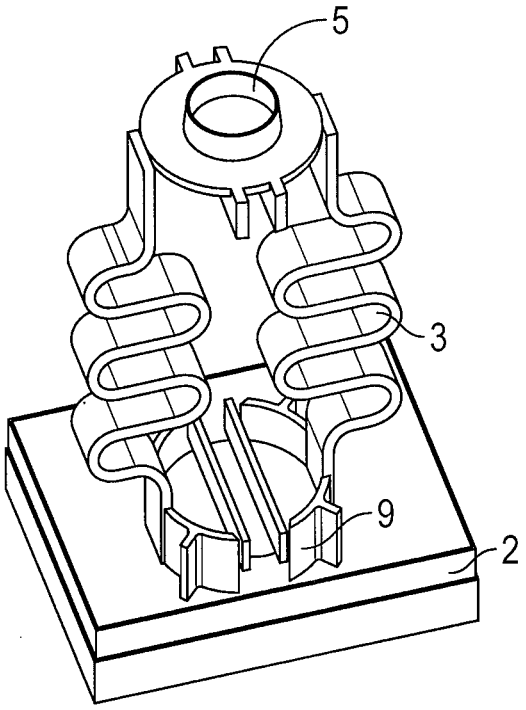
FIG. 4A shows an embodiment of the container apparatus in which the spring structure is held from a vessel body cap, and a plug is frusto-conical and has a thin wall section.

The alignment structure 9, 10 may serve to locate the spring structure 3 within the vessel body 1, for example center the spring structure 3 at a longitudinal center axis (see FIG. 7). In one example, as best seen in FIG. 2 and in FIG. 4A, the alignment structure 9, 10 may be implemented as a cylindrical tube whose base is attached to the inner face of the end wall, and in which lengthwise cutouts are formed that provide clearance, as shown in FIG. 4A, so that the vertical or straight end portions of the spring structure 3 can be inserted into the tube. The spring structure 3 is thus held, to reduce sideways motion while the spring is pre-loaded during assembly of the vessel body 1. The alignment structures 9, 10 are tall enough so that even when the spring structure 3 is further loaded (to allow the liquid to flow out of the vessel body 1) the vertical end portions of the spring structure 3 remain within the lengthwise cutouts of the cylindrical tube (so that the spring structure 3 remains centered). Such a tube may be molded as part of the vessel body cup 8 (the upper alignment structure 10 which extends from the upper end wall 11—see FIG. 2) and as part of the vessel body cap 2 (the lower alignment structure 9 extending inward from the inner face of the lower end wall 12—see FIG. 2). In this manner, the alignment structures may be integrated with the vessel body 1, for ease of assembly, to serve in alignment of the spring structure 3. Other design for the alignment structures 9, 10 are possible.

Figure 5:
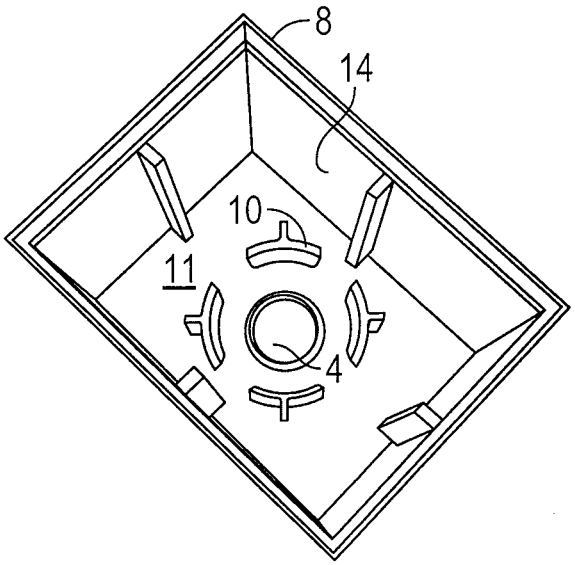
FIG. 5 shows a bottom perspective view looking into a vessel body cup (of the embodiment of FIG. 2).

Still referring to FIG. 2, to ease assembly of the vessel body 1, the vessel body 1 may be divided into two portions, namely a vessel body cup 8 and a mating vessel body cap 2. The cap 2 has a sidewall 15 (which may be shorter than depicted—see for example the embodiment of FIG. 9) that is shaped to mate with a lower end of a cup sidewall 14 of the vessel body cup 8, to close off the interior cavity of the vessel body 1. See also FIG. 3, as well as FIG. 5 which is a view looking into the vessel body cup 8 (while the vessel body cap 2 has been removed). That view also shows the upper alignment structure 10 (which was described above) surrounding the upper hole 4 and extending inward from the inner face of the upper end wall 11).

In one embodiment, referring back to FIG. 2, the spring structure 3 can move longitudinally relative to the vessel body 1 in that it is not rigidly attached to the vessel body 1. In that case, the spring structure 3 would slide out of the vessel body cup 8, once the vessel body cap 2 is removed as shown in FIG. 2. In FIG. 4A, the spring structure 3 is permanently joined to the upper plug 5 and lower plug 7 as a single piece that is resting against the vessel body cap 2, and this combination as a whole slides down and out of the vessel body cup 8 as the cap 2 is removed.

Figure 4B:
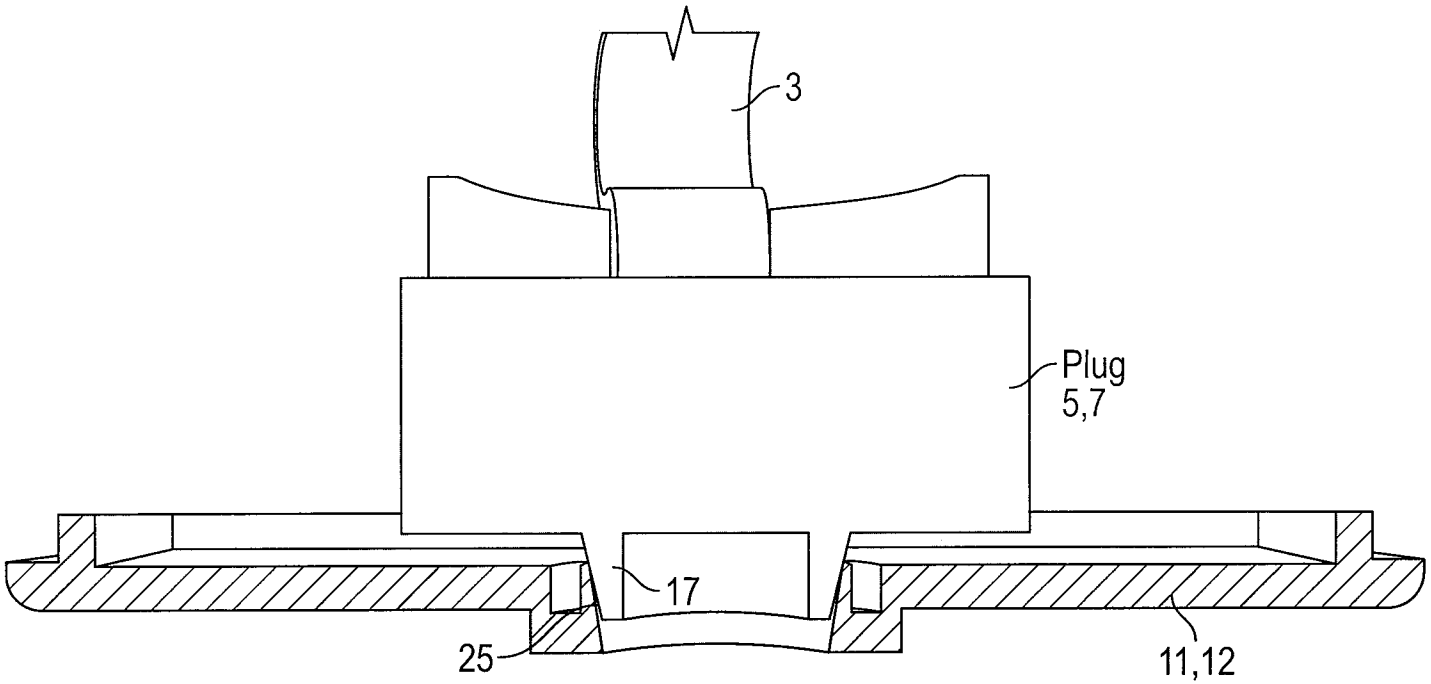
FIG. 4B depicts a close up view of another example of a plug in contact with an edge of the end wall that defines its respective hole.

In the embodiments of FIG. 1 and FIGS. 4A-4B each of the plugs 5, 7 has a frusto-conical end, with a base whose diameter is larger than that of its respective hole 4,6. As best seen in FIG. 4B, in these embodiments, a side 17 of the plug 5, 7 comes into contact with and forms a valve seal against an edge 25 of the end wall (upper end wall 11 or lower end wall 12). The edge 25 defines the respective hole, which, in most instances, is expected to be circular (as shown). Note however that the end of the upper plug 5 may have a different structure and size than that of the lower plug 7, just as the edge 25 that defines the upper hole 4 may have a different structure and size than that of the edge 25 that defines the lower hole 6. In one embodiment, the end of a plug (either the upper plug 5, the lower plug 7, or both) may be described as having a round (e.g., circular), tapered side 17. The round side is larger in diameter than its mating hole 4, 6, so that it cannot be pushed through its hole and can form a seal against the edge 25 (that defines its respective hole). In the embodiment shown in FIG. 1, the sealing sides of the plugs 5, 7 taper inward, i.e. they are inclined toward the center longitudinal axis (see FIG. 7) as they extend from the base of the plug.

In one embodiment, the side 17 of the plug may be part of a "thin wall" section (as seen for example in the upper plug 5 depicted in FIG. 4A) such that it is designed to deform and seal against the edge 25 of the end wall (that defines the respective hole). The edge 25 may also be tapered inward, i.e. it is inclined toward the center longitudinal axis (see FIG. 7) as it extends from the inner face of the end wall 11, 12, as seen in the upper and lower end walls 11, 12 shown in FIG. 1 and in FIG. 4B. The thin wall section of the plug is sufficiently thin so as to deform in order to seal the hole 4, 6, where the force needed to create this deformation is produced by the pre-loaded spring structure 3, which pushes the thin wall section of the plug against the edge of the end wall.

Other valve structures are possible for what may be referred to here as the inlet valve (representing the upper plug 5 and the edge 25 of the upper wall 11 that defines the upper hole 4), and the outlet valve (representing the lower plug 7 and the edge 25 of the lower wall 12 that defines the lower hole 6). For example, as an alternative to a tapered thin wall section at the end of a plug (as shown in FIG. 4A), or the end of a plug being frusto-conical, the thin wall section of a plug, or the side 17 of a plug, could be straight or vertical (not shown) while the edge 25 of the end wall 11, 12 (with which the side 17 comes into contact to form a valve seal) is tapered. An example of such a tapered edge 25 is shown in FIG. 1.

Yet another example plug-and-edge combination that can form a valve seal is shown in FIG. 4B. In this close up view, it can be seen that the inward taper or angle of the edge 25 (that defines the hole in the end wall 11, 12), relative to an imaginary vertical plane that intersects the side of the edge 25, is smaller than the taper or angle of the outer surface of the side 17 of the plug 5, 7 (relative to an imaginary vertical plane that intersects the side 17 of the plug 5, 7). Also, in this embodiment, the side of the edge 25 is formed as a thin wall section. The latter deforms to create a better valve seal, when the preloaded spring 3 pushes the plug 5, 7 against the thin wall section of the edge 25.

Although not shown, the valve seal could also be made against a soft or resilient seal or o-ring (e.g., made of rubber) that has been fitted into a channel formed in either a) the outer surface of the side 17 of the plug (upper plug 5 or lower plug 7) or b) the outer surface of the side of the edge 25 that defines the lower hole 6 or the upper hole 4.

Figure 6:
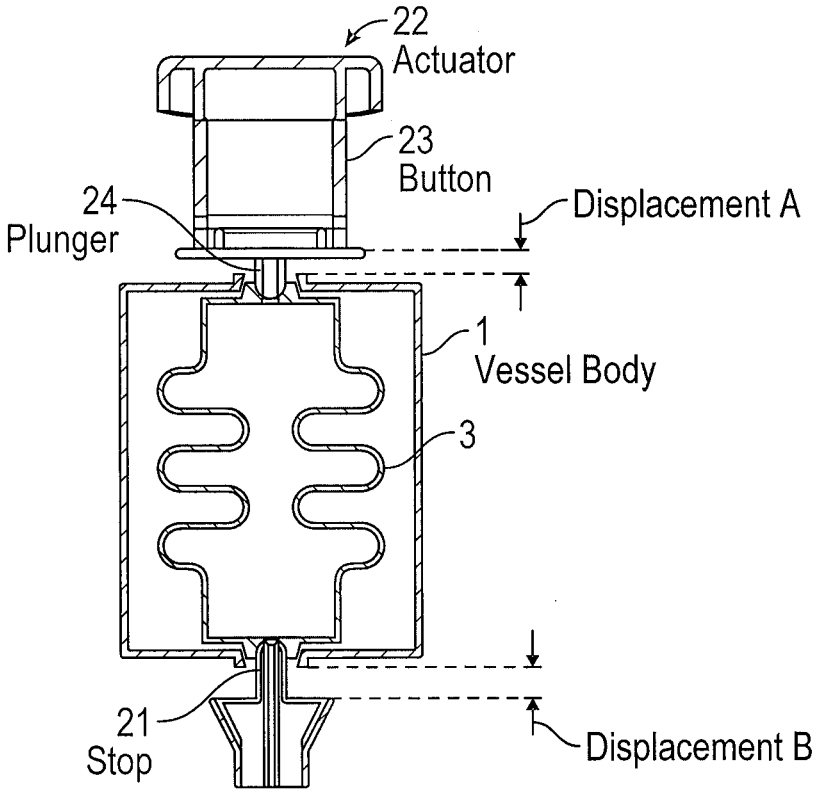
FIG. 6 is a section view illustrating displacement of an actuator and the resulting displacement of the vessel body during pouring.

Turning now to FIG. 6, this is a section view of the vessel body 1 with an example actuation mechanism that works to enable liquid to flow out of the vessel body 1 (downward through the lower hole 6). An actuator 22 is provided outside of the vessel body 1 which is in this example positioned to push downward (when actuated) against the upper plug 5 as shown. In the pre-actuation state shown, the lower plug 7 is resting against a narrow portion (or tip) of a stop structure 21 that is also outside of the vessel body. In one embodiment, the spring structure 3 has a high enough spring constant such that the lower hole of the vessel body 1 remains obstructed in this state by the lower plug 7, while a) the vessel body 1 has been filled with liquid, b) the actuator 22 is not pushing against the upper plug 5, and c) the lower plug 7 is resting against the stop structure 21. The narrow portion of the stop structure 21 is positioned to stop downward movement of the lower plug 7 while being narrow enough to allow downward movement of the vessel body 1.

The actuator 22 may be actuated, by for example its button 23 being manually pressed downward by a user. This may result in a narrow portion (or post) of an attached plunger 24 (that may be attached to the button 23 directly as shown, or indirectly through a force redirection mechanism—not shown) abutting the upper plug 7, and then producing a downward displacement A of the upper plug 7. The post or narrow portion of the plunger 24 is sufficiently narrow so as to preferably not rub against the edge 25 and not push against the vessel body 1. This results in the spring structure 3 being loaded further (that is, beyond the preloaded condition in the pre-actuation state). Since the spring structure 3 is free to move longitudinally within the vessel body 1, the vessel body 1 now moves (falls) downward, under force of gravity, by a displacement B (indicated in the figure as a displacement of the outer face of the lower end wall 12.). Initially, the displacement B is essentially equal to displacement A. This results in the watertight seal between the upper and lower plugs and the vessel body 1 being broken, so that air flows past the post of the plunger 24 and in through the upper hole, while simultaneously liquid pours out of the vessel body 1 through the lower hole and past the post of the stop structure 21. In other words, displacement B allows the liquid to flow out, while displacement A allows air to flow in. Thus, the liquid container apparatus simultaneously vents and dispenses liquid. Note that to enhance liquid flow, the gap between the side of the narrow portion of the stop structure 21 and the edge 25 that defines the lower hole 6 can be made larger, by for example making the narrow portion of the stop structure 21 narrower. Similarly, to enhance venting, the initial gap that is created (upon actuation) between the side of the plunger 24 and the edge 25 that defines the upper hole 4 can be made larger, by for example making the plunger 24 narrower.

Viewed another way, and still referring to the embodiment of FIG. 6, when the actuator 22 (and in particular the button 23) pushes down against the upper plug (and not the upper wall in which the upper hole is formed), this action further loads the spring structure 3 against the stop structure 21 which in turn "releases" the vessel body 1 from the spring structure 3, thereby allowing the interior cavity of the vessel body 1 to vent through the upper hole while the vessel body 1 moves downward (e.g., under force of gravity alone), thereby un-obstructing the lower hole and in turn allowing the liquid to pour out of the lower hole under force of gravity alone.

The amount of liquid that flows out is controlled by the length of time that the actuator 22 remains actuated (e.g., in this case, so long as the button 23 remains depressed). In one embodiment, the maximum volume of liquid that can flow out of the vessel 1 during dispensing (while the button 23 is depressed so that spring structure 3 is loaded beyond its pre-load condition) is fixed, and is the amount (or volume) of liquid that was filled into the vessel body 1. When the button 23 is released, the spring structure 3 pushes the plunger 24 (and hence the button 23) back to the original position (the pre-actuation state shown in FIG. 6) while the vessel body 1 itself also rises back up to its original position. In such an embodiment, the button 23 and the plunger 24 are not spring loaded, and as such may be returned to the pre-actuation state solely due to the force generated by the released spring structure 3. If the actuation was relatively short such that not all of the volume of liquid in the vessel body 1 was able to flow out, then upon releasing of the button 23, the inlet and outlet valves of the vessel become closed again thereby trapping some remainder volume of liquid in the vessel body 1.

During a complete actuation cycle (starting with the pre-actuation state in which the button 23 is not depressed, and then the actuation state in which the button 23 is depressed, and then releasing of the button 23 to return to the pre-actuation state) the narrow portion or post of the stop structure 21 may remain fixed and in contact with the lower plug 7 at all times. Note here that while FIG. 6 shows the pre-actuation state in which the plunger 24 is in contact with the upper plug 5, an alternative is to design the actuator 22 to have some "play" or gap between the tip of its plunger 24 and the face of the upper plug 5 (while in the pre-actuation state).

Also, still referring to FIG. 6, if displacement A represents how far the wide portion of the plunger 24 (which is just above its narrow portion or post) can travel before it contacts the vessel body 1 (at which point no further loading of the spring structure 3 can occur at the top of the vessel body 1), then pressing the button 23 further will cause the wide portion of the plunger 24 to push the vessel body 1 downward thereby making displacement B (the distance that the vessel body 1 drops from its position in the pre-actuation state) greater than displacement A, until the lower end wall 12 of the vessel body 1 comes into contact with another fixed structure that may act as a stop (e.g., a wide portion of the stop structure 21, which in one case may be the end of a pipe 19 that defines its inlet—see FIG. 7). That may represent the largest opening for allowing the liquid to flow out of the vessel body 1.

The embodiment of FIG. 6 in which the actuator 22 pushes downward against the upper plug while the stop structure 21 is positioned to stop downward movement of the lower plug, yields a desirable solution for collecting the liquid that flows out of the vessel body 1 through the lower hole, by having the inlet of a pipe 19 surround the narrow portion (or post) of the stop structure 21—see also FIG. 7 described below. As an example, the post of the stop structure 21 may be affixed only to the inner surface of the pipe 19 as shown in FIG. 6, and not to the outer surface of the pipe 19, which may help reduce the chance of spillage of the liquid that flows down along the side of the post of the stop structure 19. Also, another example feature shown in FIG. 6 is that the pipe 19 forms a funnel, i.e. its inlet is wider than its downstream "neck." Other variations to the stop structure 21 and the pipe 19 are possible.

It may be possible to position the actuator 22 so that it pushes upward against the lower plug 7 (rather than downward against the upper plug 5). In that case, the stop structure 21 would be positioned to stop upward movement of the upper plug 5. This embodiment, although not shown, essentially exchanges the positions of the actuator 22 and the stop structure 21, and may work to enable the liquid to flow out from the lower hole while simultaneously venting air into the vessel body 1 through the upper hole.

In most instances, it is expected that the vessel body 1 will be mounted or installed within a dispenser frame such that it is held essentially vertical. However, the container apparatus may also work if the vessel body 1 is tilted; but it should not be tilted so much that the liquid spills out from the upper hole (when force is being applied that loads the spring structure which opens the top and bottom valves, in order to dispense the liquid). FIG. 7 shows an example of how the vessel body 1 can be part of a beverage dispensing system. This is an example application of the vessel body 1, for dispensing a beverage (the liquid contained in the vessel body 1) into a drinking cup 20. Although not shown here, additional vessel bodies 1 may be provided within the dispensing structure shown so that more than one beverage is dispensed (from more than one vessel body 1) into the same drinking cup 20. A mechanism for collecting the liquid (being a beverage in this example) includes a pipe 19 that is located outside of the vessel body 1 as shown, and positioned so that its inlet may receive all of the liquid that flows out of the vessel body 1, under force of gravity alone, through the lower hole (which is initially obstructed by the lower plug 7). In this case, the narrow portion of the stop structure 21 may be conveniently fixed just above the end of the pipe 19 that defines its inlet, for example along the center longitudinal axis as shown. Alternatively, the stop structure 21 may be affixed to a dispenser frame 16 directly. The dispenser frame 16 may serve to rigidly position the pipe 19 and the actuator 22 (relative to the vessel body 1). The dispenser frame 16 has a sidewall that is sized and shaped so that the vessel body 1 rests loosely against the sidewall, to enable the vessel body 1 to slide downward under force of gravity alone, until the lower plug 7 rests against the stop structure 21. The vessel body 1 and the dispensing system are now ready for actuation. A user can manually press down on the button 23 to result in the liquid being dispensed through the lower hole, and then collected by the pipe 19 before being guided into the drinking cup 20 below.

In this example, the sidewall of the dispenser frame 16 is shaped and sized so that the longitudinal center axis of the vessel body 1 passes through centers of the upper and lower holes as shown, which are also kept vertical, while the dispenser frame 16 is resting on a horizontal surface (e.g., the top of a table or counter). The dispenser frame 16 may, as in this example, be positioned on a top end of a dispenser base 18, the latter having a bottom end that may rest against the horizontal surface. The dispenser base 18 has an open space between its top end and its bottom end as shown, into which the drinking cup 20 has been positioned and is aligned with an outlet of the pipe 19 (so that the liquid that flows out of the vessel body 1 pours from the outlet of the pipe 19 into the drinking cup 20). Although a fairly straightforward dispensing structure is shown for guiding the liquid that flows out of the vessel body 1 and into another vessel such as the drinking cup 20 in this case, more complex liquid collection and channeling structures or pipes can be used, particularly where more than one vessel body 1 is used whose liquids may be combined into the same drinking cup 20.

Figure 8:
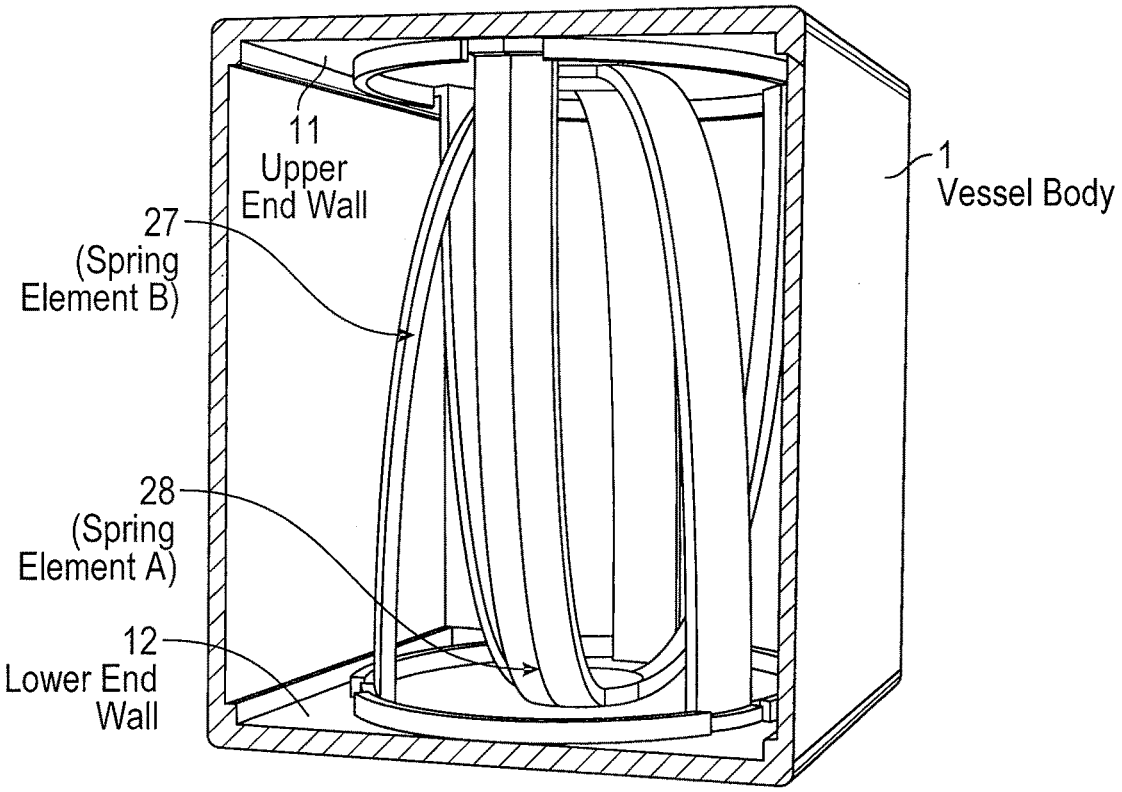
FIG. 8 depicts another embodiment of the container apparatus, in which a different spring structure is used.

The spring structure 3 that has been described in connection with the figures so far has one or more spring elements that are pre-loaded while their upper end abuts the upper plug, and their lower end abuts the lower plug (to generate the needed force to push against the upper and lower plugs). FIG. 8 is another embodiment of the spring structure 3, which also creates the needed forces against the upper and lower plugs, but in a different way. As seen in FIG. 8, the spring structure 3 has two spring elements 28, 27. Spring element 28 is pre-loaded within the vessel body 1, while its upper end abuts the upper end wall 11 but not the upper plug. In contrast, its lower end abuts the lower plug but not the lower end wall 12. This can also be seen in the view of FIG. 9 in which the vessel body cup 8 is not shown, to make it easier to see the details of the spring elements 28, 27. Spring element 28 has, in this example, three legs 28-1, 28-2, 28-3, each of which extends from the lower plug upwards. The far ends of the legs 28-1, 28-2, and 28-3 abut the inner face of the upper end wall 11 (see also FIG. 8). Each of the legs may serve to provide part of the spring force needed to maintain the lower plug in its obstructed position, although in general there may be as few as two such legs, or more than three.

In a similar manner, the spring element 27 is also pre-loaded, however its upper end abuts the upper plug 5 as shown, while its bottom end and, in particular, the far ends of its three legs 27-1, 27-2, and 27-3 abut the lower end wall 12 (and not the lower plug 7). The spring element 27 serves to maintain the upper plug in its obstructed position.

Figure 9:
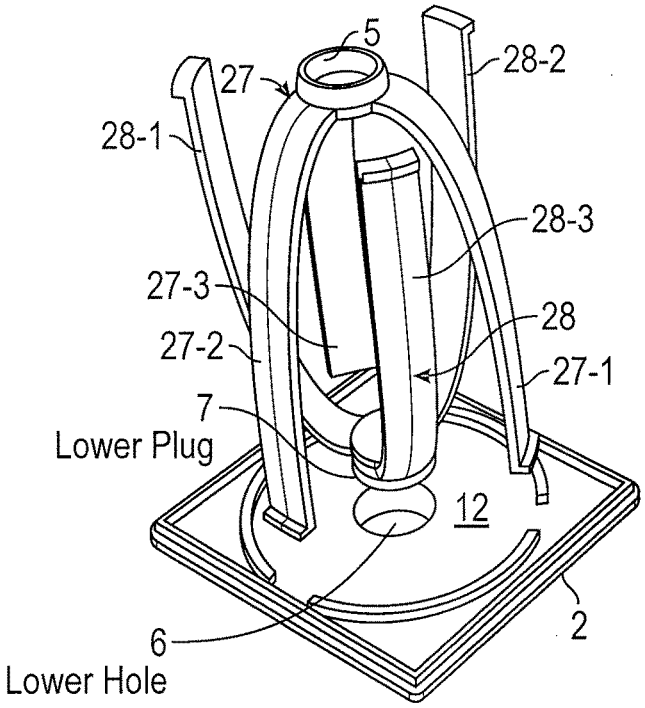
FIG. 9 is a perspective view of the spring structure of FIG. 8.

In the embodiment of FIG. 8 and FIG. 9, as compared to the embodiment of FIG. 2 and FIG. 4, the alignment structures 9, 10 may not be needed (for purposes of aligning the spring structure 3 and the lower and upper plugs. However, there may be a locating structure (formed on the face of each of the end walls as shown—see for example in FIG. 9 where a short wall is formed with cutouts therein that serve to locate the ends of the legs 27-1, 27-2, and 27-3 while they abut the lower end wall 12. The springs 28, 27 are also compression type strings that are pre-loaded when the vessel body cap 2 is joined to the vessel body cup 8 (similar in this aspect to FIG. 2) so as to enclose the vessel body 1 with the two spring elements 28, 27 being compressed into their pre-loaded condition, thereby maintaining the upper plug 5 and the lower plug 7 in their obstructed conditions. Also, note here how the spring structure 3 (of the embodiment of FIG. 8 and FIG. 9) may also be implemented by plastic injection molding, and wherein the spring element 28 may be formed as a single piece of injection molded plastic along with the lower plug 7, while the spring element 27 may be injection molded as a single piece along with the upper plug 5.

Figure 10:
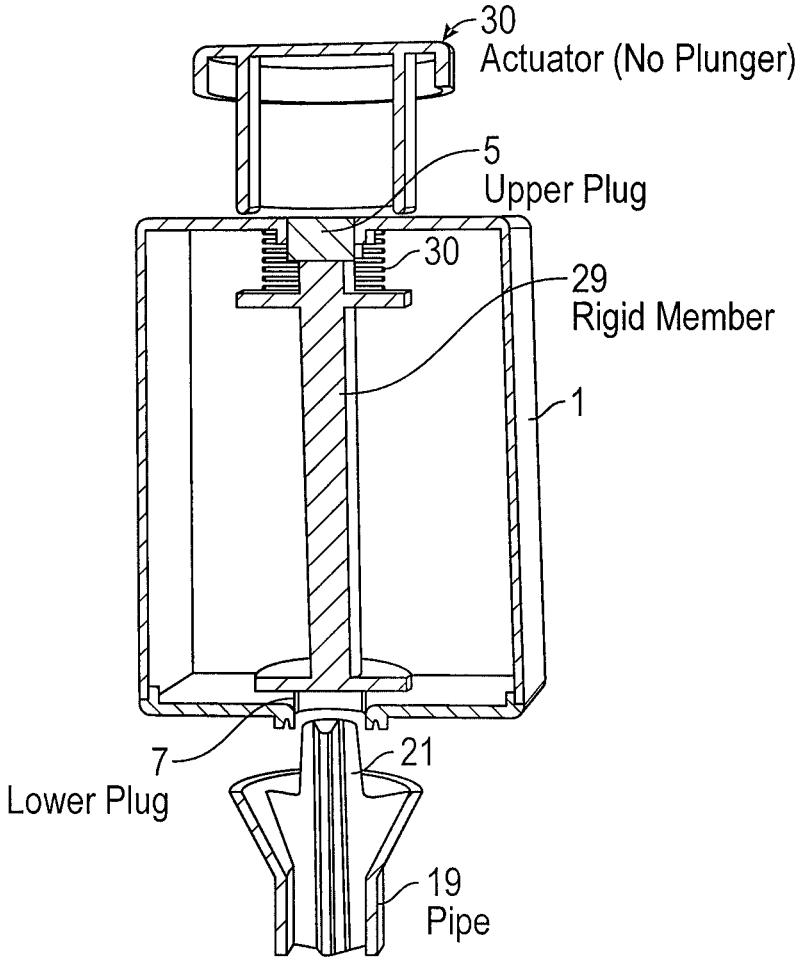
FIG. 10 is yet another embodiment of the container apparatus in which the spring structure has a rigid member that rigidly joins the upper plug to the lower plug.

Referring now to FIG. 10, yet another embodiment of the spring structure 3 is shown, where in this case a rigid member 29 joins the upper plug 5 to the lower plug 7 as shown. A spring element 29 is pre-loaded as shown, where its upper end abuts the inner face of the upper end wall, while its lower end abuts the rigid member 29 at a laterally extending shelf (which extends out from an otherwise elongated rod-like structure of the rigid member 29). The spring element 29 may be a simple coil spring as shown, or other type of spring, that has a high enough spring constant to maintain the inlet and outlet valves closed except in this case the inlet valve may be different in structure than in the embodiment of FIG. 1. Here, the inlet valve is represented as the combination of an upper plug 5 that fits against an edge of the upper end wall 11 (that defines the upper hole), wherein the diameter (sidewall) of the upper plug 5 is not tapered as in FIG. 1 but rather vertical. An o-ring (not shown) may be fitted into a channel formed in the vertical sidewall of the upper plug 5 to form a sealing surface (sealing diameter), which ensures the watertight seal of the inlet valve when the sealing diameter is properly positioned against the edge of the upper end wall.

Also different in the embodiment of FIG. 10 is how the liquid is dispensed from the vessel body 1. Here, the actuator 22, while outside of the vessel body 1, is positioned to push downward against the vessel body 1 but not against the upper plug 5. The narrow portion (or post) of the stop structure 21 of the previous embodiments serves the same purpose here, namely to prevent downward movement of the lower plug (while allowing the vessel body 1 to move downward). As the actuator 22, and in this case a button without a plunger, is pressed downward by the user, the button pushes against the vessel body 1 directly (here, directly against the top face of the upper end wall of the vessel body 1), which pushes the vessel body 1 downward against the top end of the spring element 30 (by virtue of the other end of the spring element 30 being fixed in a longitudinal direction by the rigid member 20 resting against the stop structure 21 through the lower plug 7). This means that the outlet valve opens (by virtue of the edge which defines the lower hole of the vessel body 1 moving downward, away from the lower plug 7). Simultaneously, the edge which defines the upper hole of the vessel body also moves downward, until it passes by the sealing diameter which is formed around the upper plug 5 at which point venting can take place, simultaneously with outflow of liquid past the lower plug 7.

In one embodiment, all of the elements that make up the various embodiments of the container apparatus described above may be made of injection molded plastic. For example, as seen in FIG. 2, the vessel body cup 8 and the vessel body cap 2 may be molded in the same plastic material, and can then be bonded together to form the vessel body 1 and its interior cavity (see FIG. 1). This bonding may be with adhesive only, or it may be by sonic welding, along a lap joint that is formed at the ends of both parts. The spring structure 3 and the upper and the lower plugs 5, 7 (all three of which may be formed as a single, injection molded piece, which is an example of "a spring" as described further below) may be made of a different plastic than the vessel body 1, e.g. polypropylene or polyoxymethylene (POM). The spring would in that case be placed inside the vessel body cup 8 and vessel body cap 2, before bonding the latter two pieces to each other. The actuator 22 (including its constituent parts, namely the button 23 and the plunger 24) of could also be made of plastic. The button 23 and the plunger 24 may be attached to each other, by means of for example rectangular posts formed on one which snap into mating holes formed in the other, or by means of other suitable mechanical joint mechanism that does not need any adhesive or other bonding operation.

The following statements of invention concerning a container apparatus for liquids can be made, in view of the foregoing description. A container apparatus for liquids comprises: a vessel having an air inlet valve for air to flow into the vessel (e.g., depicted in the figures as the combination of a vessel body 1, and the edge in the upper end wall 11 that defines the upper hole 4 in combination with the upper plug 5), and a liquid outlet valve for a liquid to flow out of the vessel under force of gravity alone (e.g., depicted in the figures as the edge in the lower end wall 12 that defines the lower hole 6 in combination with the lower plug 7; and a spring structure inside the vessel (e.g., spring structure 3 including its variants as depicted in the figures) that simultaneously biases both the air inlet valve and the liquid outlet valve into their closed positions.

In one embodiment, liquid inside the vessel does not emerge from the vessel through either the air inlet valve or the liquid outlet valve, when the valves are in their closed positions, both when the vessel is being vertically held right side up as well as upside down. As explained above, in one embodiment, the valves are designed such that the vessel can be held upside down so that it can pour from the upper hole (as well as right side up where it pours from the lower hole).

The container apparatus is such that when the vessel contains a volume of liquid, the vessel vents through the air inlet valve and the liquid pours out through the liquid outlet valve simultaneously, in response to a force that loads the spring structure beyond a pre-load condition that was biasing the valves closed. All of the volume of liquid pours out of the vessel under force of gravity alone, in response to the spring structure staying loaded, beyond the pre-load condition, for a sufficient period of time.

Various valve designs were described. In one embodiment, the air inlet valve comprises: a plug; and a hole formed in an end wall of the vessel, wherein the plug is frusto-conical with a base whose diameter is larger than that of the hole, and wherein a side of the plug forms a valve seal against an edge of the end wall that defines the upper hole.

The following additional statements of invention can be made in view of the description above. A container apparatus for liquids comprises: a vessel body having an interior cavity in which a liquid is to be contained, an upper hole 4 that communicates with the interior cavity, and a lower hole 6 that communicates with the interior cavity; and a spring inside the vessel body that is in a pre-loaded condition and that plugs the upper hole and the lower hole. The "spring" in this case is depicted in the various figures as the combination of the spring structure 3 abutting and joined to the upper plug 5 at one end and to the lower plug 7 at another end. In other words, the plugs 5, 7 are viewed in this case as part of "the spring."

Variations on the spring include the one-piece version depicted in FIG. 4, and the ones shown in FIGS. 8-9 (two spring elements 27, 28 as separate pieces) and in FIG. 10 (a spring element 30 and a separate rigid member 29).

Thus, the embodiment of FIG. 4 may be viewed as having a spring that comprises a compression spring structure, which is compressed in the pre-loaded condition, and wherein an upper end of the spring is adapted to plug the upper hole 4 while a lower end of the spring is adapted to plug the lower hole 6. Viewed in this manner, the upper end of the spring is a disk (e.g., circular with a straight or vertical side, or frusto-conical with a tapered or angled side) whose side forms a liquid tight seal against an edge of the vessel body that defines the upper hole. Similarly, the lower end of the spring is also a disk whose side forms a liquid tight seal against another edge of the vessel body that defines the lower hole.

Figure 11:
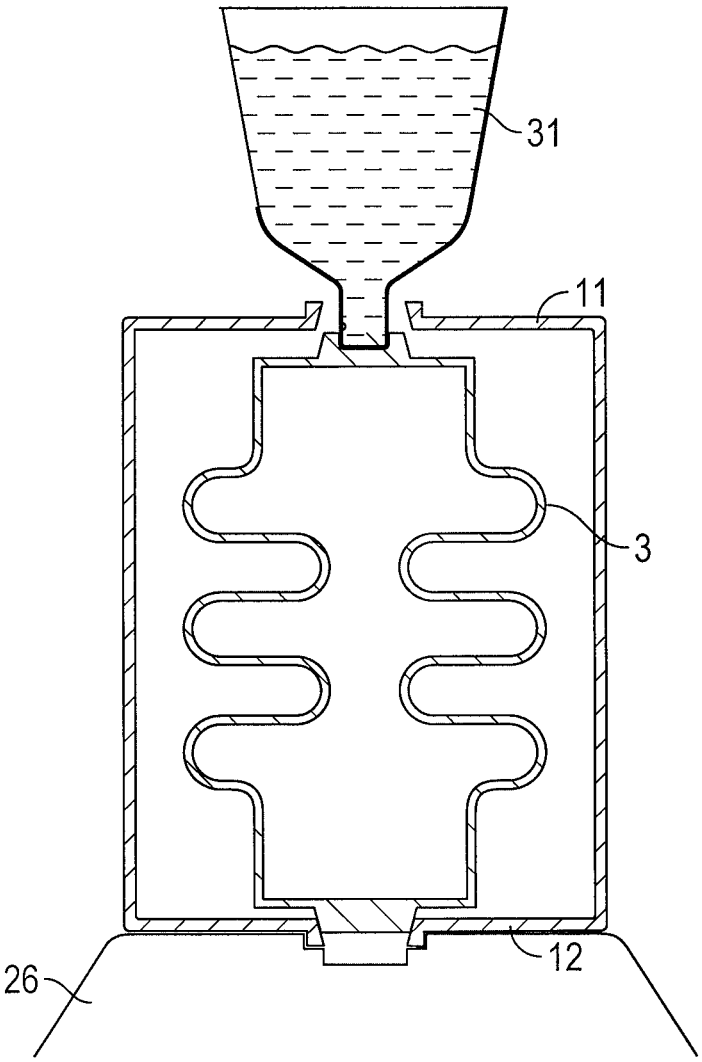
FIG. 11 shows an example of how an embodiment of the vessel can be filled with liquid.

The vessel body 1 may be filled using the technique shown in FIG. 11. The lower end wall 12 of the vessel body 1 may be placed on a stand 26, while a neck of a cup 31 is inserted into the vessel body 1 through its upper hole. The cup is pressed downward to open the inlet valve, by the neck pushing against the upper plug downward (which further loads the spring structure 3 beyond its pre-load condition). The outlet valve however remains closed (because the lower plug remains spring loaded against the lower hole of the vessel body 1, since the stand 26 is holding up the vessel body 1 but is not touching the lower plug). Accordingly, liquid in the cup 31 can flow directly into and fills the vessel (through an opening or valve that is in the neck of the cup 31), through the open inlet valve (while any needed venting may occur past the neck of the cup 31). When there is sufficient liquid that has filled the vessel body 1, the cup 31 may simply be lifted up and away from upper plug, thereby causing the spring structure 3 to close the inlet valve (and resume its preload condition). The outlet valve remains closed during this fill cycle, and the vessel body 1 (now filled with liquid) may now be removed from the stand 26. Other techniques for filling the vessel body 1 are possible.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the vessel body 1 depicted in the various figures is a polyhedron, the vessel body 1 may alternatively have a different shape, e.g., ellipsoid, spheroid, or even an irregular 3D solid in which the upper and lower end walls 11, 12 are still defined as being joined by the sidewall 13 to provide an interior cavity that can be filled with a liquid. The description is thus to be regarded as illustrative instead of limiting.

What is claimed is:

1. A container apparatus for liquids, comprising:

a vessel body having an interior cavity in which a liquid is to be contained, an upper hole that communicates with the interior cavity, and a lower hole that communicates with the interior cavity;

an upper plug that fits the upper hole;

a lower plug that fits the lower hole; and a spring structure inside the vessel body that is pre-loaded and that simultaneously a) positions the upper plug to obstruct the upper hole, and b) positions the lower plug to obstruct the lower hole, wherein the spring structure comprises a spring element that is pre-loaded while its upper end abuts the upper plug and its lower end abuts the lower plug.

2. The container apparatus of claim 1 wherein the spring element, the upper plug, and the lower plug are formed as a single piece.

3. The container apparatus of claim 1 wherein the vessel body has an upper end wall in which the upper hole is formed, a lower end wall in which the lower hole is formed, and a sidewall that joins the upper end wall and the lower end wall to close off the vessel body.

4. The container apparatus of claim 3 further comprising:
an upper alignment structure on an inner face of the upper end wall of the vessel body to limit sideways movement of an upper end of the spring structure; and
a lower alignment structure on an inner face of the lower end wall of the vessel body to limit sideways movement of a lower end of the spring structure.

5. The container apparatus of claim 1 further comprising:
an actuator outside of the vessel body and positioned to push downward against the upper plug; and
a stop structure outside of the vessel body, and positioned to stop downward movement of the lower plug.

6. The container apparatus of claim 5 wherein the vessel body has an upper end wall in which the upper hole is formed, a lower end wall in which the lower hole is formed, and a sidewall that joins the upper end wall and the lower end wall to close of the vessel body, and wherein when the actuator is actuated to produce a maximum downward displacement of the upper plug, there is an essentially equal downward displacement of the lower end wall.

7. The container apparatus of claim 5 further comprising a pipe outside of the vessel body and positioned so that its inlet can receive all of the liquid that flows out of the vessel body, under force of gravity alone, through the lower hole, and wherein the stop structure is affixed to the pipe.

8. The container apparatus of claim 7 further comprising a dispenser frame to which the pipe and actuator are affixed, wherein the dispenser frame has a sidewall that is sized and shaped so that the vessel body rests loosely against the sidewall so that the vessel body can move downward under force of gravity alone until the lower plug rests against the stop structure.

9. The container apparatus of claim 8 wherein the dispenser frame sidewall is shaped and sized so that an axis of the vessel body that passes through centers of the upper and lower holes is kept vertical while the dispenser frame is resting on a horizontal surface.

10. The container apparatus of claim 7 further comprising:
a dispenser frame to which the pipe and the actuator are affixed; and
a dispenser base having a bottom end that is to rest against a horizontal surface, and a top end on which the dispenser frame is positioned, wherein the dispenser base has an open space, between its top end and its bottom end, into which a drinking cup is to be positioned and that is aligned with an outlet of the pipe so that the liquid that flows out of the vessel body pours from the outlet of the pipe into the drinking cup.

11. The container apparatus of claim 5 wherein the spring structure has a high enough spring constant such that the lower hole remains obstructed while a) the vessel body is full of liquid, b) the actuator is not pushing against the upper plug, and c) the lower plug is resting against the stop structure.

12. A container apparatus for liquids, comprising:
a vessel having an air inlet valve for air to flow into the vessel, and a liquid outlet valve for a liquid to flow out of the vessel under force of gravity alone, wherein the air inlet valve comprises a plug and a hole formed in an end wall of the vessel, wherein the plug is frustoconical with a base whose diameter is larger than that of the hole, and wherein a side of the plug forms a valve seal against an edge of the end wall that defines the hole; and
a spring structure inside the vessel that simultaneously biases both the air inlet valve and the liquid outlet valve into their closed positions.

13. The container apparatus of claim 12 wherein liquid inside the vessel does not emerge from the vessel through either the air inlet valve or the liquid outlet valve, when the valves are in their closed positions, both when the vessel is being vertically held right side up as well as upside down.

14. The container apparatus of claim 12 wherein when the vessel contains a volume of liquid, the vessel vents through the air inlet valve and the liquid pours out through the liquid outlet valve simultaneously, in response to a force that loads the spring structure beyond a pre-load condition that was biasing the valves closed.

15. The container apparatus of claim 14 wherein all of the volume of liquid pours out of the vessel under force of gravity alone, in response to the spring structure staying loaded, beyond the pre-load condition, for a sufficient period of time.

16. A container apparatus for liquids, comprising:
a vessel body having an interior cavity in which a liquid is to be contained, an upper hole that communicates with the interior cavity, and a lower hole that communicates with the interior cavity; and
a spring inside the vessel body that is in a pre-loaded condition and that plugs the upper hole and the lower hole, wherein the spring comprises a compression spring structure that is compressed in the pre-loaded condition, and wherein an upper end of the spring structure is adapted to plug the upper hole and a lower end of the spring structure is adapted to plug the lower hole.

17. The container apparatus of claim 16 wherein the upper end of the spring structure is a circular disk whose sidewall forms a liquid tight seal against and a circular edge of the vessel body that defines the upper hole.

18. A container apparatus for liquids, comprising:
a vessel body having an interior cavity in which a liquid is to be contained, an upper hole that communicates with the interior cavity, and a lower hole that communicates with the interior cavity wherein the vessel body has an upper end wall in which the upper hole is formed, a lower end wall in which the lower hole is formed, and a sidewall that joins the upper end wall and the lower end wall to close off the vessel body;
an upper plug that fits the upper hole;
a lower plug that fits the lower hole;
a spring structure inside the vessel body that is pre-loaded and that simultaneously a) positions the upper plug to obstruct the upper hole, and b) positions the lower plug to obstruct the lower hole;
an upper alignment structure extending downward from an inner face of the upper end wall of the vessel body to limit sideways movement of an upper end of the spring structure; and
a lower alignment structure extending upward from an inner face of the lower end wall of the vessel body to limit sideways movement of a lower end of the spring structure.

19. The container apparatus of claim 18 wherein the spring structure comprises a spring element, wherein the spring element, the upper plug, and the lower plug are formed as a single piece.

20. The container apparatus of claim 18 further comprising:
an actuator outside of the vessel body and positioned to push downward against the upper plug; and
a stop structure outside of the vessel body, and positioned to stop downward movement of the lower plug.

21. The container apparatus of claim 20 further comprising a pipe outside of the vessel body and positioned so that its inlet can receive all of the liquid that flows out of the vessel body, under force of gravity alone, through the lower hole.

22. The container apparatus of claim 21 further comprising a dispenser frame to which the pipe and actuator are affixed, wherein the dispenser frame has a sidewall that is sized and shaped so that the vessel body rests loosely against the sidewall so that the vessel body can move downward under force of gravity alone until the lower plug rests against the stop structure.

23. The container apparatus of claim 21 further comprising:

a dispenser frame to which the pipe and the actuator are affixed; and a dispenser base having a bottom end that is to rest against a horizontal surface, and a top end on which the dispenser frame is positioned, where the dispenser base has an open space, between its top end and its bottom end, into which a drinking cup is to be positioned and that is aligned with an outlet of the pipe so that the liquid that flows out of the vessel body pours from the outlet of the pipe into the drinking cup.

24. A container apparatus for liquids, comprising:

a vessel body having an interior cavity in which a liquid is to be contained, an upper hole that communicates with the interior cavity, and a lower hole that communicates with the interior cavity;

an upper plug that fits the upper hole;

a lower plug that fits the lower hole;

a spring structure inside the vessel body that is pre-loaded and that simultaneously a) positions the upper plug to obstruct the upper hole, and b) positions the lower plug to obstruct the lower hole;

an actuator outside of the vessel body and positioned to push downward against the upper plug; and a stop structure outside of the vessel body, and positioned to stop downward movement of the lower plug.

25. The container apparatus of claim 24 wherein the vessel body has an upper end wall in which the upper hole is formed, a lower end wall in which the lower hole is formed, and a sidewall that joins the upper end wall and the lower end wall to close off the vessel body.

26. The container apparatus of claim 25 further comprising:

an upper alignment structure on an inner face of the upper end wall of the vessel body to limit sideways movement of an upper end of the spring structure; and a lower alignment structure on an inner face of the lower end wall of the vessel body to limit sideways movement of a lower end of the spring structure.

27. The container apparatus of claim 24 wherein when the actuator is actuated to produce a maximum downward displacement of the upper plug, there is an essentially equal downward displacement of the vessel body.

28. The container apparatus of claim 24 further comprising a pipe outside of the vessel body and positioned so that its inlet can receive all of the liquid that flows out of the vessel body, under force of gravity alone, through the lower hole.

29. The container apparatus of claim 28 further comprising a dispenser frame to which the pipe and actuator are affixed, wherein the dispenser frame has a sidewall that is sized and shaped so that the vessel body rests loosely against the sidewall so that the vessel body can move downward under force of gravity alone until the lower plug rests against the stop structure.

30. The container apparatus of claim 28 further comprising:

a dispenser frame to which the pipe and the actuator are affixed; and a dispenser base having a bottom end that is to rest against a horizontal surface, and a top end on which the dispenser frame is positioned, wherein the dispenser base has an open space, between its top end and its bottom end, into which a drinking cup is to be positioned and that is aligned with an outlet of the pipe so that the liquid that flows out of the vessel body pours from the outlet of the pipe into the drinking cup.

31. The container apparatus of claim 24 wherein the spring structure has a high enough spring constant such that the lower hole remains obstructed while a) the vessel body is full of liquid, b) the actuator is not pushing against the upper plug, and c) the lower plug is resting against the stop structure.

* * * * *